United States Patent [19]

Robison, Jr.

[11] Patent Number: 4,956,009

[45] Date of Patent: Sep. 11, 1990

[54] CALCIUM ALLOY STEEL ADDITIVE AND METHOD THEREOF

[75] Inventor: James W. Robison, Jr., Wexford, Pa.

[73] Assignee: Reactive Metals and Alloys Corporation, West Pittsburg, Pa.

[21] Appl. No.: 456,530

[22] Filed: Dec. 26, 1989

Related U.S. Application Data

[63] Continuation-in-part of Ser. No. 232,968, Aug. 17, 1988, abandoned.

[51] Int. Cl.[5] ..... C21C 7/06; C21C 7/064

[52] U.S. Cl. ..... 75/307; 75/537; 75/310; 75/315; 420/415; 420/129

[58] Field of Search ..... 75/251, 252, 254, 255, 75/57, 58; 420/415, 129

[56] References Cited

U.S. PATENT DOCUMENTS

| | | | |
|---|---|---|---|
| 2,819,956 | 1/1958 | Strauss | 75/58 |
| 4,035,892 | 7/1977 | Ototani et al. | 75/58 |
| 4,286,984 | 9/1981 | Luyckx | 75/58 |
| 4,671,820 | 6/1987 | Ototani et al. | 75/58 |
| 4,698,095 | 10/1987 | Ototani et al. | 75/58 |

*Primary Examiner*—Deborah Yee

*Attorney, Agent, or Firm*—Buchanan Ingersoll; Barry I. Friedman

[57] ABSTRACT

A granular additive alloy designed for addition of calcium to molten steel to obtain maximum calcium effects with minimal additions, especially in steels which cannot tolerate the other elements commonly accompanying calcium additions. An alloy is described which contains a ratio of not more than 2.85:1 nor less than 0.35:1 calcium to aluminum, and can contain other reactive metals such as, but not limited to, rare earths, boron, titanium, and zirconium in amounts up to 40% by weight of the alloy. The preferred embodiment is an alloy with 60% by weight calcium and 40% by weight aluminum. The particles are intended to dissolve in the molten steel and form a boundary layer adjacent their surfaces. The particles are sized such that substantially all of the particle is consumed in the formation of this boundary layer, according to a given relationship based on the concentration of calcium and aluminum in the alloy.

10 Claims, No Drawings

CALCIUM ALLOY STEEL ADDITIVE AND METHOD THEREOF

CROSS REFERENCE TO RELATED APPLICATION

This application is a continuation, in part, of U.S. Ser. No. 232,968 filed Aug. 17, 1988, now abandoned.

BACKGROUND OF THE INVENTION

1. Field of the Invention

The invention relates to specialty steel additive alloys containing calcium. More specifically, the invention is intended to provide a calcium-containing, carbon-free, silicon-free additive for steel which will give optimal effectiveness of the calcium added, without introducing deleterious materials into the steel and without the excessive turbulence accompanying other products and techniques.

2. Description of the Prior Art

Calcium is frequently added to steel to deoxidize, desulfurize, and to alter the characteristics of oxide and sulfide inclusions. The benefits of calcium in steel are well and amply documented in the technical literature. However, calcium boils at 1487° C. (2709° F.), whereas the molten steel to be treated is usually in the temperature range 1540°-1650° C. (2800°-3000° F.). Metallic calcium rapidly and often violently boils in the molten steel, resulting in poor efficiency, extensive re-oxidation of the steel, and inconsistent calcium effects.

To control the boiling of calcium during calcium addition, several techniques have been employed, both individually and in combination. In one technique, calcium is added at levels of about 0.25 kg/ton (0.025% by weight) as a relatively chemically stable compound with carbon ($CaC_2$, "calcium carbide") or silicon ($CaSi_2$, "calcium silicide"). The compound may be added by pneumatic injection through a refractory lance or by feeding a powder-core wire. While this method reduces boiling of calcium, each 0.01% calcium added to the steel introduces 0.01% carbon or 0.02% silicon. This level of addition is unacceptable for some grades of steel. Indeed, some grades of steel specify no deliberate addition of carbon or silicon.

Another common technique is to plunge masses of metallic calcium mechanically mixed or alloyed with large amounts of non-volatile materials such as steel, nickel, or manganese. The large amounts of non-volatile materials serve as a heat sink, slowing the rate at which the calcium boils. This technique results in excessive temperature losses and is often inconsistent in its calcium effects. Further, the non-volatile materials may themselves be deleterious in the steel being treated. While such plunging "alloys" or mixtures reduce the rate of calcium boiling, they do not prevent it. Consequently, deleterious effects of re-oxidation are not avoided.

Another common technique for calcium addition disclosed in U.S. Pat. Nos. 4,035,892; 4,671,820; and 4,698,095 to Ototani, et. al., utilizes metallic calcium or calcium alloys enclosed in a sheath of suitable metal, usually steel, which "wire" is then mechanically injected into the molten steel. In one case such a metallic calcium-cored wire is injected through a refractory lance. Obviously, those wires containing alloys of calcium with carbon or silicon suffer the disadvantages cited above for these alloys.

The injection of metallic calcium-cored wire is based upon the assumption that ferrostatic pressure will suffice to prevent boiling of the metallic calcium, if only the calcium can reach sufficient depths before reaching the temperature of the molten steel, and that boiling can be suppressed long enough for the liquid calcium to dissolve in the molten steel. However, this is unlikely to occur. As shown in Table I, the vapor pressure of calcium at steelmaking temperatures requires immersion depths (based on approximately 0.2 atmospheres per foot of depth) well in excess of the depths available in most steelmaking ladles.

TABLE I

| T, °F. | $VP_{Ca}$ Atmos. | $VP_{Ca}$ Gauge* | Critical Depth. (Ft) |
|---|---|---|---|
| 2800 | 2.65 | 1.65 | 8.3 |
| 2850 | 3.13 | 2.13 | 10.6 |
| 2900 | 3.67 | 2.67 | 13.4 |
| 2950 | 4.35 | 3.35 | 16.8 |
| 3000 | 4.97 | 3.97 | 19.8 |

*Note: Normal atmospheric pressure provides 1 atmosphere.

Moreover, injection using these techniques leads to globules of liquid calcium whose size approximates the diameter of the wire or plunging alloy used. Such wires typically are from 5 mm to 25 mm in diameter. The low density of the calcium (1.5 g/cc) compared to the density of the molten steel (approximately 7.15 g/cc) causes these globules to rise rapidly in the steel. Even if the ladle depth were such as to allow the calcium to be injected well below the Critical Depth, the globules quickly rise to the Critical Depth, where they flash to vapor.

As vapor, the calcium bubbles are very large, and very rapidly rise through the steel and the slag and are lost into the atmosphere. In passing through the steel and slag, the calcium bubbles induce strong stirring in the liquid steel, reducing the transit time of the calcium which follows.

The surface turbulence created by the calcium vapor increases the loss of heat from the steel. This must then be accommodated by increasing the temperature at the start of treatment. Increased starting temperatures, however, decrease the efficiency of the calcium addition, so more is needed and still more temperature is lost.

The rate of absorption of calcium into the molten steel is also severely limited by the very low solubility of calcium in steel, reported to be only 0.032% by weight in a pressurized system at 2925° F. In most such systems, the rate limiting mechanism is diffusion through a quasi-static boundary layer whose thickness is usually in the range 0.1-1.0 mm. Industrial experience indicates that the combination of low transit time, auto-induced stirring, low solubility of calcium in steel and diffusion-limited mass transport results in low and erratic utilization of the added calcium and in highly variable calcium effects in the product steel.

SUMMARY OF THE INVENTION

This invention is designed for addition of calcium to molten steel to obtain maximum calcium effects with minimal additions, especially in steels which cannot tolerate the other elements commonly accompanying calcium additions. These other elements are used to improve efficiency of the addition and to reduce the costs of the additive. Such steels include, but are not limited to, low-carbon, low-silicon grades intended for severe forming applications and conventional steels where additional amounts of such elements would exceed the specification limits for the steel.

An additive is disclosed which will introduce calcium into liquid steel with a minimum of turbulence and which maximizes the efficiency of the calcium addition in achieving desirable metallurgical effects. A compound is disclosed which is a granular alloy additive for use in the treatment of liquid steel comprising calcium and aluminum having a ratio of not more than 2.85:1 nor less than 0.35:1 by weight, respectively. The diameter of the particles is determined by the specific composition thereof, such that substantially all of the particle is consumed in the diffusion of the material into the quasi-steady state boundary layer. The granular alloy additive may also be comprised of 60% calcium and 40% aluminum by weight, having granules sized within the range −14 U.S. Standard mesh to +140 U.S. Standard mesh.

The alloy additive may also comprise an additional alloying element comprising up to 40% by weight of an additive selected from the group consisting of titanium, zirconium, rare earths, boron and ferroalloys thereof. Non-alloying additional elements may also be added, comprising up to 40% by weight of the additive, selected from the group consisting of titanium, zirconium, rare earths, boron and ferroalloys thereof. These elements may be introduced to the additive by mechanical mixing. Non-reactive additional elements comprising up to 80% by weight of the alloy additive may be added, selected from the group consisting of lime, fluorspar, borax, calcium aluminates, and alumina. These elements are also mechanically blended into the alloy additive.

The alloy additive is intended to dissolve in liquid steel or ferrous alloys when pneumatically or mechanically injected in the steel.

These and other advantages and features of the present invention will be more fully understood on reference to the presently preferred embodiments thereof and to the appended drawings.

Description of the Preferred Embodiments

Figure 1:
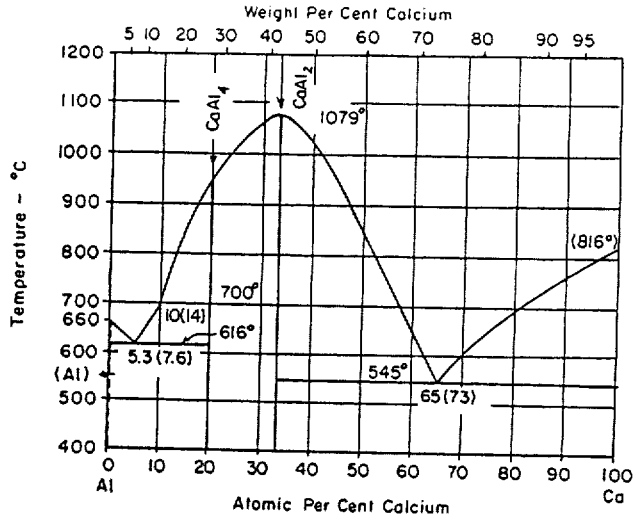
FIG. 1 is a phase diagram of the Calcium-Aluminum mixture of the invention.

The additive contains a ratio of not more than 2.85:1 nor less than 0.35:1 calcium to aluminum by weight as an alloy, and can contain other reactive metals such as, but not limited to, rare earths, boron, titanium, and zirconium in amounts up to 40% by weight of the alloy. The preferred embodiment is an alloy with 60% by weight calcium and 40% by weight aluminum.

The combination of additive composition and particle sizing is necessary for full utilization of the invention. The Calcium-Aluminum phase diagram, reproduced here as FIG. 1, would lead many to believe that aluminum would have little effect on the thermodynamic activity, and hence vapor pressure, of calcium since much of the phase diagram is dominated by a eutectic field. However, the stability of the calcium-aluminum compounds indicate that calcium, in the alloys of interest here, will exhibit a negative deviation from Raoultan (ideal) behavior. This is evidenced by the melting points of the calcium-aluminum compounds, compared to the melting points of the pure metals, and the wide gap between the liquidus temperature and the temperatures of interest in steelmaking. Comparisons with analogous systems for which more data are available supports this finding. Indeed, experimentation utilizing an alloy having the composition of 50% CaO, 30% Ca and 20% Al has revealed a significant, observable reduction in boiling and turbulence.

This means that an alloy with 60% calcium and 40% aluminum by weight (0.5 mole fraction calcium and 0.5 mole fraction aluminum) will exhibit a vapor pressure of calcium that is less than half the vapor pressure of pure calcium under the same conditions. Table II shows the effect of such a change in vapor pressure on the Critical Depth required to suppress boiling.

TABLE II

| | Vapor Pressure, Atmos. | | Critical Depth, ft. | |
|---|---|---|---|---|
| T, °F. | Pure Ca | 60/40 Alloy | Pure Ca | 60/40 Alloy |
| 2800 | 2.65 | 1.33 | 8.3 | 1.63 |
| 2850 | 3.13 | 1.57 | 10.6 | 2.83 |
| 2900 | 3.67 | 1.84 | 13.4 | 4.18 |
| 2950 | 4.35 | 2.18 | 16.8 | 5.88 |
| 3000 | 4.97 | 2.49 | 19.8 | 7.43 |

Table II shows that in even the largest ladles at 2900° F. or greater it is not possible to suppress boiling of pure calcium, since the required Critical Depth exceeds any reasonable ladle depth. This alloy, however, will suppress boiling at much shallower depths. The transit time for an injected particle or globule to go from the depth of injection to the Critical Depth is greatly expanded, thus allowing much more of the calcium in each particle to enter the steel before the onset of boiling. This in turn reduces the amount of calcium which is available to flash to vapor at the Critical Depth, so less auto-induced stirring can occur, less temperature is lost per unit of calcium added and less calcium is lost to the atmosphere.

Others have used a mechanical mixture of metallic calcium and metallic aluminum. Such a mechanical mixture was advocated in the belief that it would yield proportionate amounts of calcium oxides and aluminum oxides in the inclusions. Such inclusions would be low-melting and non-deformable, and therefore less deleterious than high-melting, brittle aluminates. However, such desirable inclusions reflect the equilibrium conditions in the steel, not the composition of the deoxidizer, and are easily produced from almost any ratio of calcium to aluminum, including pure metallic calcium (added to aluminum-containing steels). Further, the individual particles of calcium and of aluminum (from which such mixtures are produced) are surrounded by a refractory layer of the respective oxide.

This refractory oxide film, although thin, prevents rapid mixing of the two metals during the very brief transit time available (usually less than two seconds), and therefore prevents the formation of the calcium-aluminum alloy. The thermodynamic benefits of the alloy, which is the basis of my invention, are thus lost. In addition, the liquid phase or phases produced from injection of such a material in the form of a wire or from plunging of such a mixture will be much larger than the optimal particle sizing, as defined below, so the unique synergistic effects of such an alloy are forfeited.

Figure 2:
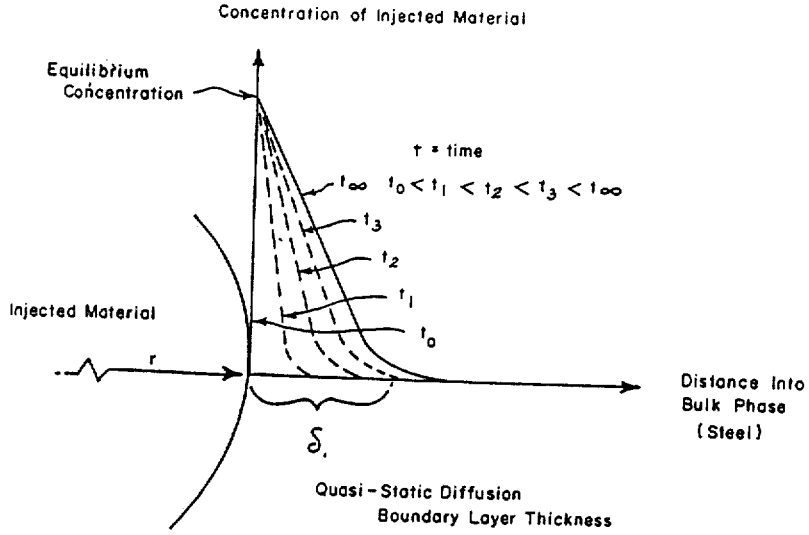
FIG. 2 is a chart showing diffusion of my additive in the boundary layer.

When a material is injected into liquid steel, the rate at which the injected material enters the steel is usually limited by diffusion through a quasi-static boundary layer. The very low solubility of calcium in steel slows the transport of calcium from the injected particle into the bulk of the steel. This boundary layer is formed almost instantaneously when an injected particle first comes in contact with the liquid steel. As shown in FIG. 2, the boundary layer grows rapidly until it reaches a quasi-static thickness, which thickness is dependent upon the kinematic viscosity of the liquid and the relative motion ("stirring") of the particle and the bulk liquid. The growth of the boundary layer is indicated by the dotted lines labeled $t_1$, $t_2$ and $t_3$. At the interface between the injected particle and liquid steel, which occurs at $t_0$, the concentration of injected material would be the saturation value for that material. In the case of pure calcium, that value would be 0.032% by weight. The boundary layer becomes established over time until it reaches the level $t_\infty$.

The amount of material, and therefore the particle size, required to establish this boundary layer can be calculated as a function of the particle surface area, the solubility of the material in the liquid bulk phase, and the density of the bulk phase, as explained below. Similarly, the amount of material contained in an injected particle is easily calculated as a function of the size of the particle, the density of the alloy and the composition of the alloy. By equating these two quantities, a critical particle size can be defined as a function of solubility level and boundary layer thickness such that the entire contents of the particle are consumed in establishing the boundary layer.

To determine the maximum particle size for a given composition, such that the entire particle is consumed in establishing the quasi-steady state boundary layer, two mutually dependent equations must be satisfied. These equations state that the gram weight of aluminum in the particle must be less than or equal to the gram weight of aluminum in the boundary layer and the gram weight of calcium in the particle must be less than or equal to the gram weight of calcium in the boundary layer. Thus, for aluminum:

$$\frac{4}{3}\pi R_o^3 \cdot \rho\text{CaAl} \cdot X_{Al} \leq \int_0^\delta 4\pi r^2 \cdot \rho\text{FeCaAl} \cdot x_{Al} \cdot dr \quad (1)$$

and for calcium:

$$\frac{4}{3}\pi R_o^3 \cdot \rho\text{CaAl} \cdot X_{Ca} \leq \int_0^\delta 4\pi r^2 \cdot \rho\text{FeCaAl} \cdot x_{Ca} \cdot dr \quad (2)$$

Where $R_o$=the initial particle radius, in mm.

CaAl=the density of the CaAl particle, approximated by a linear function of composition as:

$$\rho\text{CaAl} = (X_{Al})(2.7\text{ g/cc}) + (1 - X_{Al})(1.5\text{ g/cc}) \quad (3)$$

$$= 1.5 + 1.2(X_{Al}) \quad (4)$$

and

Ca=1.5 g/cc;

Al=2.7 g/cc;

Fe=7.8 g/cc $X_{Ca}$, $X_{Al}$=weight fraction of calcium, aluminum in the particle $x_{Ca}$, $x_{Al}$=weight fraction of calcium, aluminum in the boundary layer δ=thickness of the quasi-steady state boundary layer, in millimeters Fe Ca Al=density of iron calcium aluminum at any point in the boundary layer, approximated by a linear function of composition as:

$$\rho\text{Fe Ca Al} = 7.8\left(1 - \left[x_{Al}(2.7) + \frac{(1 - x\text{Al})}{(X_{Al})}(1.5)\right]\right) \quad (5)$$

$$= 7.8 - 6.5\frac{(x_{Al})}{(X_{Al})} + 1.2x_{Al}. \quad (6)$$

Thus, $$(7)\ x_{Al} = C^\circ_{Al}(1 - r/\delta)$$

where $C^\circ_{Ca}$, $C^\circ_{Al}$ approximate the equilibrium interfacial concentration of calcium or aluminum; and r=the radial position in the boundary layer.

By inserting terms (4), (6) and (7) in equations (1) and (2) and integrating, one can roughly calculate an upper limit on particle size for a given concentration of calcium and aluminum. While the calculation is intended to establish this upper limit from a practical viewpoint, it is specifically stated that this calculation is an approximation, based on the knowledge in the art. This proper sizing will permit rapid dissolution of the particle into the boundary layer. Thus, $$\frac{4}{3}\pi R_o^3(1.5 + 1.2(X_{Al})) = (0.65)(C^0_{Al})(\delta^3) + (C^0_{Al})^2\left[\frac{(1.5 - 6.5)}{(X_{Al})}\ \frac{(\delta^3)}{(30)}\right]. \quad (8)$$

Larger particles will dissolve more slowly, reducing their metallurgical effectiveness, while smaller particles are no more effective than particles sized near this upper limit.

For example, the preferred embodiment of the alloy contains 40% aluminum and 60% calcium. If:

$X_{Al}$=0.4 (i.e., 40% Al, 60% Ca)

$C^\circ_{Al}$=0.1; and

δ=0.7 mm, by inserting these values and solving for $R_o$, one can determine the maximum diameter. $C^\circ_{Al}$ is not determinable empirically, but an estimation of 0.1 is in keeping with the knowledge in the field.

$$\frac{4}{3}\pi R_o^3(1.5 + 1.2(.4)) = 4\pi(0.65)(.1)(.7)^3 + (.1)^2\left[\frac{(1.5 - 6.5)}{(.4)}\ \frac{(.7)^3}{(30)}\right] \quad (8a)$$

$$\frac{R_o^3}{3}(.79) = .0223 - .0069 = .02061$$

$R_o^3$=0.0783

$R_o$=0.428 millimeters

The diameter of the particle is equal to $2R_o$ and is therefore approximately 0.856 millimeters, or 20 mesh.

The critical particle size has been given as a function of solubility level and boundary level thickness such that the entire contents of the particle are consumed in establishing the boundary layer. When this condition is met, the maximum particle size is determined.

A particle of the dimensions given above or smaller would "dissolve" into the liquid steel almost instantaneously whereas the residuum of larger particles would be subject to the comparatively slow process of diffusion through this boundary layer.

As aluminum has unlimited solubility in liquid steel, the presence of large amounts of aluminum in my alloy significantly alters the boundary layer by increasing the concentration of calcium. A co-diffusion couple is established with large amounts of calcium being introduced into the liquid steel phase with the aluminum. While the solubility of calcium in liquid iron-aluminum alloys is unknown above 10% aluminum, the effects are nonetheless predictable. As above, a critical particle size can be defined by assuming reasonable values of the boundary layer thickness and reasonable values of the solubility of calcium in this aluminum-rich layer. Such examination suggests alloy particle sizes that will exhibit significantly enhanced dissolution rates compared to similar sized particles of pure calcium or calcium in concert with other materials which do not increase the solubility of calcium in steel.

Thus, I combine a chemical composition, as an alloy rather than mechanical mixtures, with particle sizing such as to optimize the effectiveness of calcium additions to steel. While much finer particle sizing would offer the same benefits as the recommended sizing, such finer sizing is more expensive to produce and is much more dangerous to handle (calcium-aluminum alloys are very pyrophoric as fine powders). To further reduce the hazards associated with handling my alloy it can be mechanically blended with up to 80% by weight of a non-combustible, non-sparking material such as, but not limited to, lime, fluorspar, borax, calcium aluminates, alumina, and other stable oxides and fluorides.

While I have described a present preferred embodiment of the invention, it is to be distinctly understood that the invention is not limited thereto but may be otherwise embodied and practiced within the scope of the following claims.

I claim:

1. A granular alloy additive for use in the treatment of molten steel comprising granules of alloyed calcium and aluminum having a ratio of not more than 2.85:1 nor less than 0.35:1 calcium to aluminum by weight, which granules during immersion in the steel will form a boundary layer adjacent their outer surface and wherein the granules are sized such that substantially all of the granule is consumed in the formation of the boundary layer, the granules being larger than 35 mesh.

2. An alloy additive as described in claim 1 further comprising an additional alloying element comprising up to 40% by weight of the additive, selected from the group consisting of titanium, zirconium, rare earth metals, boron and ferroalloys thereof.

3. An alloy additive as described in claim 1 further comprising an additional element comprising up to 40% by weight of the additive, selected from the group consisting of titanium, zirconium, rare earth metals, boron and ferroalloys thereof, wherein the additional element is introduced to the additive by mechanical mixing.

4. An alloy additive as described in claim 1, further comprising a non-reactive additional element comprising up to 80% by weight of the alloy additive, selected from the group consisting of lime, fluorspar, borax, calcium aluminates, and alumina, wherein the additional element is mechanically blended into the alloy additive.

5. A method for adding calcium to molten steel comprising the steps of preparing an alloy additive comprised of granules of calcium and aluminum having a ratio of not more than 2.85:1 nor less than 0.35:1 by weight, wherein the granules are larger than 35 mesh, but not larger than 1.0 mm in diameter and injecting the alloy additive into the molten steel.

6. The method of claim 5 wherein the alloy additive is pneumatically injected.

7. The method of claim 5 wherein the alloy is mechanically injected.

8. The method of claim 5 also comprising the additional step of alloying with the alloy additive at least one additional material selected from the group consisting of titanium, zirconium, rare earth metals, boron and ferroalloys thereof, before injecting the alloy additive.

9. The method of claim 5 also comprising the additional step of mixing with the alloy additive a material selected from the group consisting of titanium, zirconium, rare earth metals, boron and ferroalloys thereof prior to injecting the alloy additive.

10. A granular alloy additive for use in the treatment of molten steel comprising granules of calcium and aluminum alloy having a ratio of not more than 2.85:1 nor less than 0.35:1 calcium to aluminum by weight, which granules during immersion in the steel will form a boundary layer adjacent their outer surface and wherein the granules are sized such that substantially all of the granule is consumed in the formation of the boundary layer, according to the formula $$\frac{4}{3}\pi R_o^3\,(1.5 + 1.2(X_{Al})) \simeq (0.65)(C^\circ_{Al})(\delta^3) + (C^\circ_{Al})^2\left[\left(1.5 - \frac{6.5}{(X_{Al})}\right)\left(\frac{\delta^3}{30}\right)\right]$$

where $R_o$ = the initial particle radius, $X_{Al}$ = weight fraction of aluminum in the particle, $C^\circ_{Al}$ = the equilibrium interfacial concentration of aluminum, and $\delta$ = thickness of the quasi-steady state boundary layer.

* * * * *

UNITED STATES PATENT AND TRADEMARK OFFICE

CERTIFICATE OF CORRECTION

PATENT NO. : 4,956,009

DATED : September 11, 1990

INVENTOR(S) : JAMES W. ROBISON, JR.

It is certified that error appears in the above-identified patent and that said Letters Patent is hereby corrected as shown below:

Column 5, line 54, before the first occurrence of "CaAl", insert --ρ--.

Column 5, line 62, before "Ca" insert --ρ--.

Column 5, line 63, before "Al" insert --ρ--.

Column 5, line 64, before "Fe" insert --ρ--.

Column 6, line 3, before "Fe Ca Al" insert --ρ--.

The title page should be deleted to appear as per attached title page.

The sheet of drawing consisting of figures 1 and 2 should be added as per attached sheet.

Signed and Sealed this

Twenty-fifth Day of December, 1990

*Attest:*

HARRY F. MANBECK, JR.

*Attesting Officer*

*Commissioner of Patents and Trademarks*

United States Patent [19]

Robison, Jr.

[11] Patent Number: 4,956,009

[45] Date of Patent: Sep. 11, 1990

[54] CALCIUM ALLOY STEEL ADDITIVE AND METHOD THEREOF

[75] Inventor: James W. Robison, Jr., Wexford, Pa.

[73] Assignee: Reactive Metals and Alloys Corporation, West Pittsburg, Pa.

[21] Appl. No.: 456,530

[22] Filed: Dec. 26, 1989

Related U.S. Application Data

[63] Continuation-in-part of Ser. No. 232,968, Aug. 17, 1988, abandoned.

[51] Int. Cl.[5] ..... C21C 7/06; C21C 7/064

[52] U.S. Cl. ..... 75/307; 75/537; 75/310; 75/315; 420/415; 420/129

[58] Field of Search ..... 75/251, 252, 254, 255, 75/57, 58; 420/415, 129

[56] References Cited

U.S. PATENT DOCUMENTS

| | | | |
|---|---|---|---|
| 2,819,956 | 1/1958 | Strauss | 75/58 |
| 4,035,892 | 7/1977 | Ototani et al. | 75/58 |
| 4,286,984 | 9/1981 | Luyckx | 75/58 |
| 4,671,820 | 6/1987 | Ototani et al. | 75/58 |
| 4,698,095 | 10/1987 | Ototani et al. | 75/58 |

*Primary Examiner*—Deborah Yee

*Attorney, Agent, or Firm*—Buchanan Ingersoll; Barry I. Friedman

[57] ABSTRACT

A granular additive alloy designed for addition of calcium to molten steel to obtain maximum calcium effects with minimal additions, especially in steels which cannot tolerate the other elements commonly accompanying calcium additions. An alloy is described which contains a ratio of not more than 2.85:1 nor less than 0.35:1 calcium to aluminum, and can contain other reactive metals such as, but not limited to, rare earths, boron, titanium, and zirconium in amounts up to 40% by weight of the alloy. The preferred embodiment is an alloy with 60% by weight calcium and 40% by weight aluminum. The particles are intended to dissolve in the molten steel and form a boundary layer adjacent their surfaces. The particles are sized such that substantially all of the particle is consumed in the formation of this boundary layer, according to a given relationship based on the concentration of calcium and aluminum in the alloy.

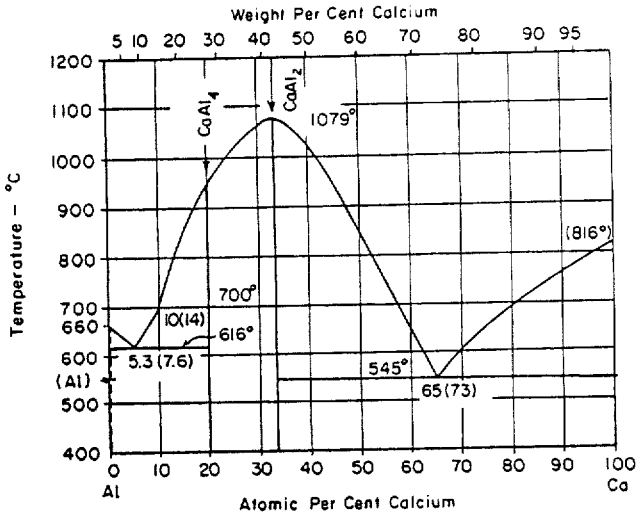

10 Claims, No Drawings